US006727662B2

(12) United States Patent
Konopka et al.

(10) Patent No.: US 6,727,662 B2
(45) Date of Patent: Apr. 27, 2004

(54) DIMMING CONTROL SYSTEM FOR ELECTRONIC BALLASTS

(75) Inventors: John G. Konopka, Deer Park, IL (US); Sivakumar Thangavelu, Rolling Meadows, IL (US); Sameer Sodhi, Vernon Hills, IL (US)

(73) Assignee: Osram Sylvania, Inc., Danvers, MA (US)

( * ) Notice: Subject to any disclaimer, the term of this patent is extended or adjusted under 35 U.S.C. 154(b) by 0 days.

(21) Appl. No.: 10/256,540

(22) Filed: Sep. 28, 2002

(65) Prior Publication Data

US 2004/0061452 A1 Apr. 1, 2004

(51) Int. Cl.[7] ..... H05B 37/02

(52) U.S. Cl. ..... 315/209 R; 315/224; 315/307; 315/56

(58) Field of Search ..... 315/DIG. 4, 209 R, 315/224, 246, 307, 320, 362, 200 R, 194, 56

(56) References Cited

U.S. PATENT DOCUMENTS

| | | | | |
|---|---|---|---|---|
| 5,404,082 A | * | 4/1995 | Hernandez et al. | 315/219 |
| 6,211,624 B1 | * | 4/2001 | Holzer | 315/224 |
| 6,424,100 B1 | * | 7/2002 | Kominami et al. | 315/307 |
| 6,504,322 B2 | * | 1/2003 | Takahashi et al. | 315/307 |
| 2002/0047608 A1 | * | 4/2002 | Takahashi et al. | 315/224 |
| 2002/0135320 A1 | * | 9/2002 | Kominami et al. | 315/224 |
| 2002/0153849 A1 | * | 10/2002 | Ribarich | 315/247 |

* cited by examiner

*Primary Examiner*—Tuyet T. Vo
(74) *Attorney, Agent, or Firm*—Kenneth D. Labudda

(57) ABSTRACT

A dimming control system includes a first circuit (100) and a second circuit (400). First circuit (100) is coupled in series with the AC line source (10) and receives brighten and dim commands from a user. The brighten and dim commands are communicated to second circuit (400) by momentarily altering the AC voltage waveforms observed by second circuit (400). Second circuit (400) provides an adjustable output signal that is coupled to inverter circuitry within an electronic dimming ballast. The output signal is adjusted by the second circuit (400) in dependence on the observed AC voltage waveforms.

12 Claims, 6 Drawing Sheets

DIMMING CONTROL SYSTEM FOR ELECTRONIC BALLASTS

RELATED APPLICATIONS

This application is related to copending application Ser. No. 09/966,911, filed Sep. 28, 2001 and entitled "Dimming Control System for Electronic Ballasts" which is assigned to the same assignee as the present invention.

FIELD OF THE INVENTION

The present invention relates to the general subject of circuits for powering discharge lamps. More particularly, the present invention relates to a dimming control system for electronic ballasts.

BACKGROUND OF THE INVENTION

Conventional dimming ballasts for gas discharge lamps include low voltage dimming circuitry that is intended to work in conjunction with an external dimming controller. The external dimming controller is connected to special inputs on the ballast via dedicated low voltage control wiring that, for safety reasons, cannot be routed in the same conduit as the AC power wiring. The external dimming controller is usually very expensive. Moreover, installation of low voltage control wiring is quite labor-intensive (and thus costly), especially in "retrofit" applications. Because of these disadvantages, considerable efforts have been directed to developing control circuits that can be inserted in series with the AC line, between the AC source and the ballast(s), thereby avoiding the need for additional dimming control wires. The resulting approaches are sometimes broadly referred to as "line control" dimming.

A number of line control dimming approaches exist in the prior art. One known type of line control dimming approach involves introducing a notch (i.e., dead-time) into each and every cycle of the AC voltage waveform at or near its zero crossings. This approach requires a switching device, such as a triac, in order to create the notch. Inside of the ballast(s), a control circuit measures the time duration of the notch and generates a corresponding dimming control signal for varying the light level produced by the ballast. In practice, these approaches have a number of drawbacks in cost and performance. A significant amount of power is dissipated in the switching device, particularly when multiple ballasts are to be controlled. Further, the method itself distorts the line current, resulting in poor power factor and high harmonic distortion, and sometimes produces excessive electromagnetic interference. Additionally, the control circuitry tends to be quite complex and expensive.

An attractive alternative approach that avoids the aforementioned drawbacks is described in copending application Ser. No. 09/966,911, filed Sep. 28, 2001 and entitled "Dimming Control System for Electronic Ballasts" which is assigned to the same assignee as the present invention. The circuitry detailed therein employs a wall-switch assembly comprising two switches and two diodes, and sends a dimming command by removing one or more positive half-cycles (corresponding to a "dim" command) or negative half-cycles (corresponding to a "brighten" command) from the AC voltage supplied to the ballast. While this approach has a number of substantial benefits over prior systems, it is not ideally suited for those ballasts that include a boost converter front-end. More specifically, because the ballasts receive only one half of the AC line cycle during a light level change, the boost converter may undesirably fall out of regulation during those times. In order prevent this problem, one would have to design the boost converter to remain in regulation down to very low levels of AC line voltage (e.g., down to about 66% of the nominal AC line voltage), which would add significant cost to the ballasts.

What is needed, therefore, is a structurally efficient and cost-effective dimming control system that avoids any need for additional dimming control wires, but that does so without introducing undesirable levels of steady-state power dissipation, line current distortion, and electromagnetic interference, and without requiring that the ballasts remain in regulation down to very low levels of AC line voltage. A need also exists for a dimming control system that is structurally efficient and cost-effective. A dimming control system with these features would represent a significant advance over the prior art.

DETAILED DESCRIPTION OF THE PREFERRED EMBODIMENTS

Figure 1:
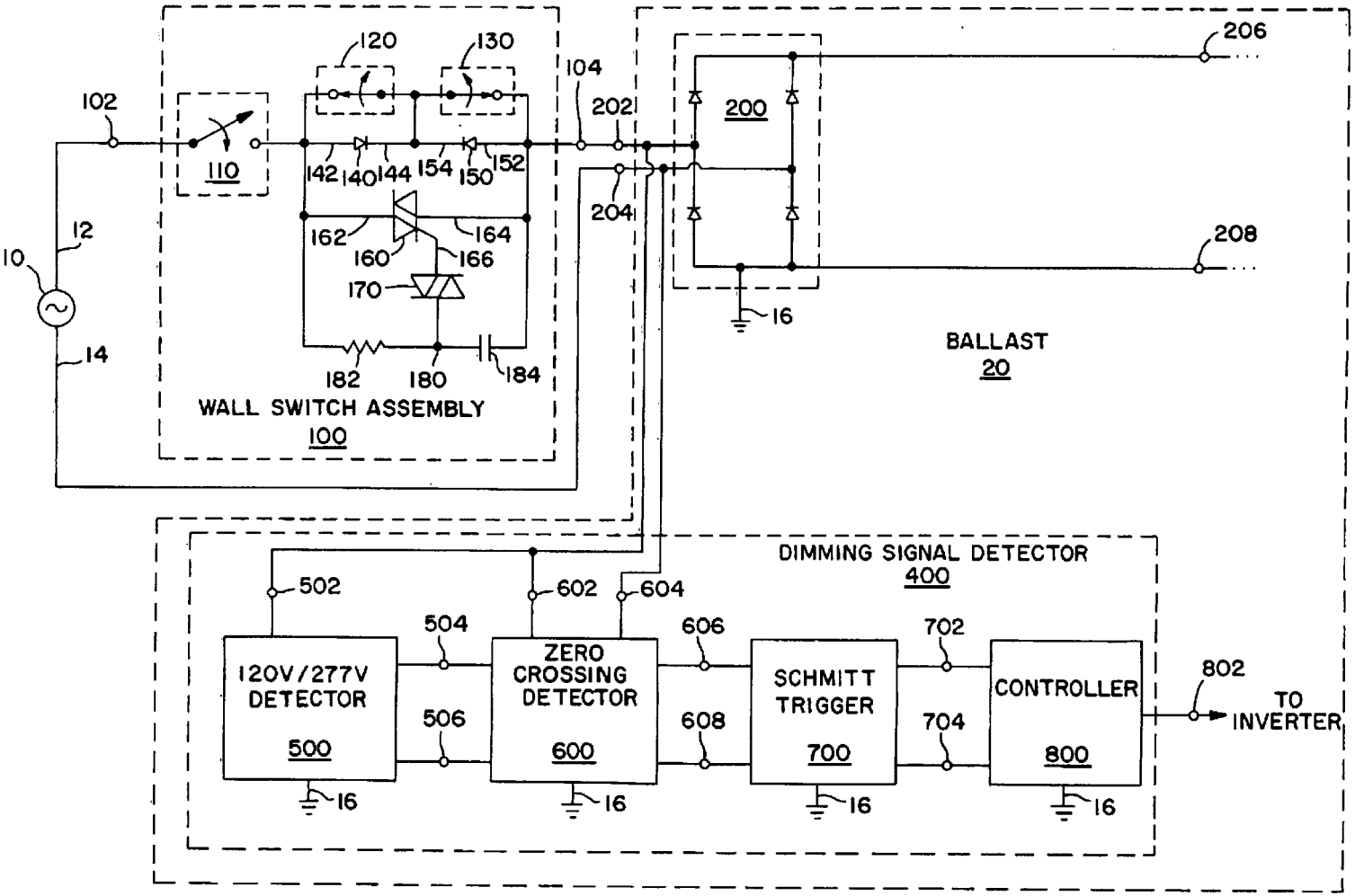
FIG. 1 describes a dimming control system that includes a wall switch assembly and a ballast having a dimming signal detector circuit, in accordance with a preferred embodiment of the present invention.

In a preferred embodiment of the present invention, as described in FIG. 1, a dimming control system comprises a wall switch assembly 100 and at least one electronic ballast 20 that includes a full-wave diode bridge 200 and a dimming signal detector 400. Wall switch assembly 100 has a first end 102 and a second end 104. Wall switch assembly 100 is intended for connection in series with a conventional alternating current (AC) source 10 (e.g., 120 volts at 60 hertz) having a hot lead 12 and a neutral lead 14. First end 102 is coupled to the hot lead 12 of AC source 10. Second end 104 is coupled to a first input terminal 202 of ballast 20. A second input terminal 204 of ballast 20 is coupled to the neutral lead 14 of AC source 10. The ground reference for the circuitry in ballast 20 is designated as ground 16.

Dimming signal detector 400 is coupled to the first and second input terminals 202,204 of ballast 20, and includes an output 802 for connection to the ballast inverter (not shown). Dimming signal detector 400 is itself situated within ballast 20. Wall switch assembly 100 is intended to be situated external to the ballast(s); and preferably within an electrical switchbox. If multiple dimming ballasts are involved, each ballast will have its own dimming signal detector 400. On the other hand, only one wall switch assembly 100 is required even if multiple ballasts are involved.

Wall switch assembly 100 includes a first switch 120, a second switch 130, a first diode 140, a second diode 150, a controllable bi-directional conductive device 160, a voltage-triggered device 170, a triggering resistor 182, and a triggering capacitor 184. Wall switch assembly 100 may also include a conventional on-off switch 110 for controlling application of AC power to at least one ballast connected downstream from wall switch assembly 100. First diode 140 has an anode 142 and a cathode 144; anode 142 is coupled to first end 102 via on-off switch 110. Second diode 150 has an anode 152 and a cathode 154; anode 152 is coupled to second end 104, and cathode 154 is coupled to cathode 144 of diode 140. Switch 120 is coupled in parallel with diode 140, while switch 130 is coupled in parallel with diode 150. Controllable bi-directional device 160 is preferably implemented as a triac having conduction terminals 162,164 and a gate terminal 166. Conduction terminal 162 is coupled to the anode 142 of first diode 140. Conduction terminal 164 is coupled to the anode 152 of second diode 150. Voltage triggered device 170 is preferably implemented as a diac that is coupled between a node 180 and the gate terminal 166 of triac 160. Triggering resistor 182 is coupled between the anode 142 of first diode 140 and node 180. Triggering capacitor 184 is coupled between node 180 and the anode 152 of second diode 150.

Switches 120,130 are preferably implemented as single-pole single-throw (SPST) switches that are normally closed and that will remain open for only as long as they are depressed by a user. Moreover, it is desirable that switches 120,130 be mechanically "ganged" so as to preclude the possibility of both switches being open at the same time. Preferably, switches 120,130 share a single three-position control lever with an up-down action wherein an up motion would open switch 120, a down motion would open switch 130, and both switches 120,130 would be closed at rest. For example, switches 120,130 may be realized via an "up arrow/down arrow" rocker type arrangement, where switch 120 is opened while the "up arrow" is depressed, switch 130 is opened while the "down arrow" is depressed, and both switches 120,130 are closed in the absence of any depression by a user.

Figure 2:
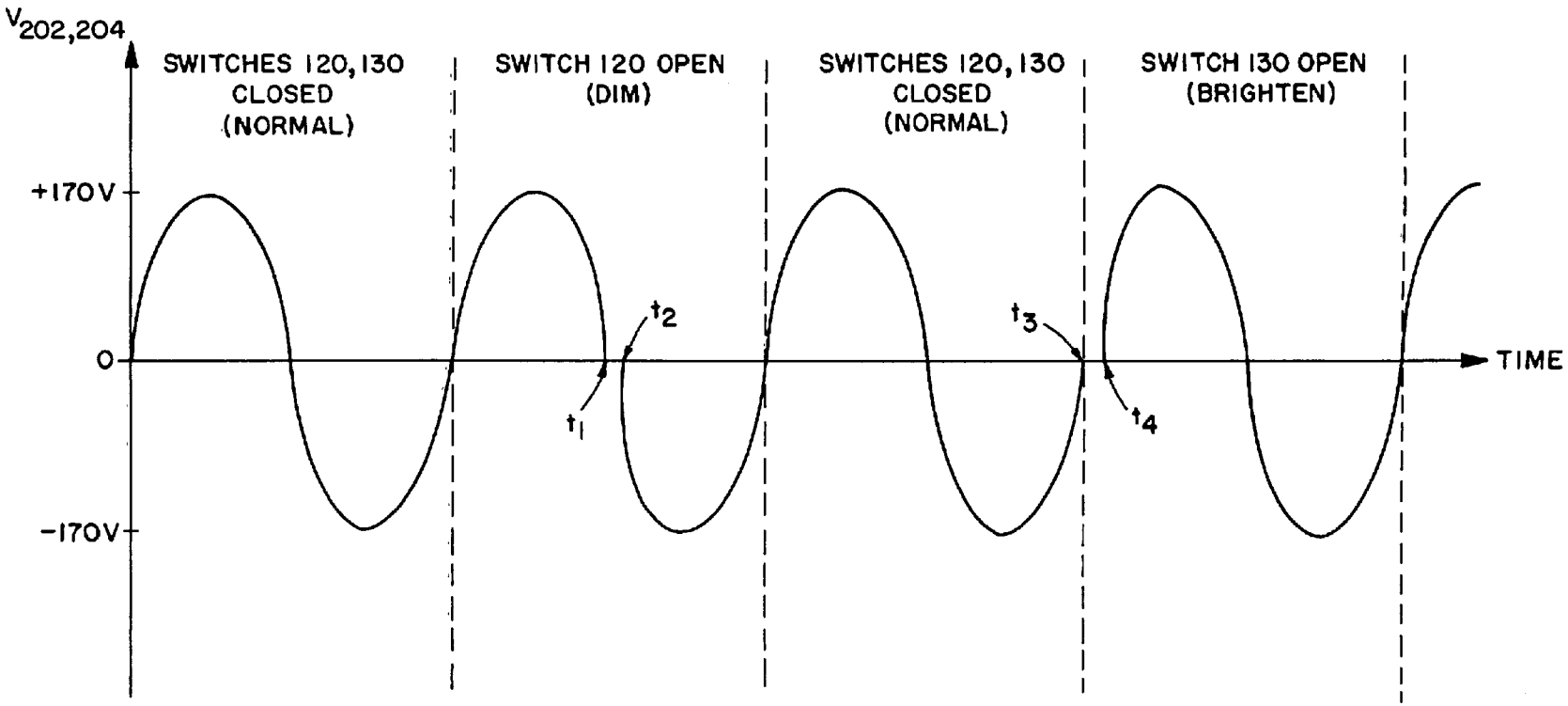
FIG. 2 describes the AC voltage provided to the ballast under different conditions during the operation of the wall switch assembly illustrated in FIG. 1.

During operation, when on-off switch 110 is in the on position, wall switch assembly 100 behaves as follows, with reference to FIGS. 1 and 2.

When both switches 120,130 are closed, diodes 140,150 are each bypassed by their respective switch, so first end 102 is simply shorted to second end 104. Thus, both the positive and the negative half cycles of the voltage from AC source 10 are allowed to pass through unaltered, and the voltage between ballast input terminals 202,204 (referred to as $V_{202,204}$ in FIG. 2) is a normal sinusoidal AC voltage.

When switch 120 is open and switch 130 is closed, positive-going current is allowed to proceed (from left to right) into first end 102, through diode 140, through switch 130 (bypassing diode 150, which blocks positive-going current), and out of second end 104. Thus, the positive half-cycle of the AC line voltage is allowed to pass through unaltered. The negative half-cycle of the AC voltage passes through via triac 160 (bypassing diode 140, which blocks negative-going current), but in a truncated manner. More specifically, the leading edge of the negative half-cycle (i.e., the portion between $t_1$ and $t_2$ in FIG. 2) will be blocked by triac 160. At time $t_1$, triac 160 is off and will remain off until such time as sufficient voltage develops across capacitor 184 in order to trigger diac 170 and turn on triac 160. Between $t_1$ and $t_2$, the voltage across capacitor 184 increases as the AC line voltage becomes increasingly negative. At time $t_2$, the voltage across capacitor 184 reaches a level high enough (i.e., the breakover voltage of diac 170) to trigger diac 170 and turn on triac 160. Thus, with switch 120 open and switch 130 closed, the voltage provided by wall switch assembly 100 to ballast input terminals 202,204 is a substantially sinusoidal AC voltage in which the positive half-cycle is unaltered and the leading edge of the negative half-cycle is truncated.

When switch 120 is closed and switch 130 is open, negative-going current is allowed to proceed (from right to left) into second end 104, through diode 150, through switch 120 (thus bypassing diode 140, which blocks negative-going current), and out of first end 102. Thus, the negative half-cycle of the AC line voltage is allowed to pass through unaltered. The positive half-cycle of the AC voltage passes through via triac 160 (bypassing diode 150, which blocks positive-going current), but in a truncated manner. More specifically, the leading edge of the positive half-cycle (i.e., the portion between $t_3$ and $t_4$ in FIG. 2) will be blocked by triac 160. At time $t_3$, triac 160 is off and will remain off until such time as sufficient voltage is applied to gate terminal 166 in order to turn the device on. Between $t_3$ and $t_4$, the voltage across capacitor 184 increases as the AC line voltage becomes increasingly positive. At time $t_4$, the voltage across capacitor 184 reaches a level high enough (i.e., the breakover voltage of diac 170) to trigger diac 170 and turn on triac 160. Thus, with switch 120 closed and switch 130 open, the voltage provided by wall switch assembly 100 to ballast input terminals 202,204 is a substantially sinusoidal AC voltage in which the leading edge of the positive half-cycle is truncated and the negative half-cycle is unaltered.

Preferably, the time periods $t_1$ to $t_2$ and $t_3$ to $t_4$ are selected to be quite short in comparison with the duration of one half-cycle of the AC line voltage, so as to preclude any negative effects regarding the line regulation of the boost converter in ballast 20. The duration of the time periods $t_1$ to $t_2$ and $t_3$ to $t_4$ is determined by the breakover voltage of diac 170, the values of resistor 182 and capacitor 184, and the magnitude of the AC line voltage.

Preferably, dimming signal detector 400 treats a depression of switch 130 (i.e., truncated positive half-cycle) as a "brighten" command and responds by increasing the level or duty cycle of its output voltage (i.e., the voltage at output 802) during the time that switch 130 remains depressed. Conversely, a depression of switch 120 (i.e., truncated negative half-cycle) is treated as a "dim" command, to which dimming signal detector 400 responds by decreasing the level or duty cycle of its output voltage. Alternatively, dimming signal detector 400 may be designed so that the aforementioned logic convention is reversed; that is, dimming signal detector 400 may be designed such that truncation of the positive half-cycle is treated as a "dim" command, while truncation of the negative half-cycle treated as a "brighten" command.

In contrast with prior art "line control" dimming approaches, such as those that employ a triac in series with the AC source, wall switch assembly 100 introduces no line-conducted electromagnetic interference (EMI) or distortion in the AC line current during normal operation (i.e., when switches 120,130 are closed). Moreover, wall switch assembly 100 dissipates no power during normal operation because the AC current drawn by any ballast(s) connected downstream flows through switches 120,130 rather than diodes 140,150. On the other hand, when one of the switches 120,130 is opened in order to send a "dim" or "brighten" signal, a small amount of power will be dissipated in one of the diodes 140,150 and in triac 160, but only for as long as the switch remains depressed. The required power rating of the diodes and the triac is dictated by the power that will be drawn by the ballast(s) connected downstream.

Referring again to FIG. 1, in a preferred embodiment of the present invention, dimming signal detector 400 includes a 120V/277V detector circuit 500, a zero crossing detector circuit 600, a Schmitt trigger circuit 700, and a controller circuit 800. 120V/277 V detector 500 includes an input 502 coupled to either input terminal 202,204 of ballast 20, and a pair of outputs 504,506 coupled to zero crossing detector 600. The function of 120V/277V detector circuit is to ensure that zero crossing detector 600 deals with essentially the same voltage levels, regardless of the actual AC line voltage. Zero crossing detector 600 includes a first input 602, a second input 604, and a pair of outputs 606,608. First input 602 is coupled to the first input terminal 202 of ballast 20. Second input 204 is coupled to the second input terminal 204 of ballast 20. Outputs 606,608 are coupled to Schmitt trigger 700. The function of zero crossing detector 600 is to detect the presence of a "dim" or "brighten" command, and to adjust the duty cycles of the signals at outputs 626,656 accordingly. Schmitt trigger 700 includes a pair of outputs 702,704 coupled to controller 800. The function of Schmitt trigger is to receive the variable duty DC signals provided by zero crossing detector 600 and provide digitized output signals (i.e., corresponding to a logic "1" or logic "0") to controller 800. Controller 800 has an output 802. The function of controller is to provide a variable signal at output 802 wherein, preferably, the duty cycle of the signal is increased in response to a "brighten" command and decreased in response to a "dim" command. Preferred structures for 120V/277V detector 500, zero crossing detector 600, Schmitt trigger 700, and controller 800 are described herein with reference FIGS. 3–6.

As alluded to previously, output 802 is intended for connection to the ballast inverter. The voltage level or the duty cycle of the signal provided at output 802 is varied in dependence on the signals provided by wall switch assembly 100, and can be used to control the inverter operating frequency or duty cycle, and hence the amount of current provided to the lamp(s), in any of a number of ways that are well-known to those skilled in the art. An example of a ballast that provides dimming through control of the inverter operating frequency is disclosed in U.S. Pat. No. 5,457,360, the pertinent disclosure of which is incorporated herein by reference.

Preferably, dimming signal detector 400 provides a low voltage, variable duty cycle voltage signal at output 802. As described herein with reference to controller circuit 800 and FIG. 8, the voltage signal at output 802 is a variable duty cycle squarewave signal with a peak value of about 5 volts, a minimum value of zero volts, and a duty cycle that can be varied (in dependence on the dimming commands from wall switch assembly 100) between about 4.44% (preferably, corresponding to an extreme "dim" setting) and about 95.6% (preferably, corresponding to an extreme "brighten" setting).

Upon initial application of AC power to ballast 20, the duty cycle of the signal at output 802 will, preferably, be at its maximum value. When a "dim" command is issued via wall switch assembly 100 (i.e., when a truncated negative half-cycle is detected), dimming signal detector 400 will reduce the duty cycle by a small amount. As successive "dim" commands are sent, the duty cycle will be reduced by a small amount for each truncated negative half-cycle that is detected. If "dim" commands continue to be sent, the duty cycle will eventually reach its minimum value and will remain at that value until such time as a "brighten" command is sent. Similarly, upon receipt of a "brighten" command (i.e., detection of a truncated positive half-cycle), dimming signal detector 400 will increase the duty cycle by a small amount. As successive "brighten" commands are sent, the duty cycle will be increased by a small amount for each truncated positive half-cycle that is detected. If "brighten" commands continue to be sent, the duty cycle will eventually reach its maximum value and will remain at that value until such time as a "dim" command is sent.

A preferred embodiment of dimming signal detector 400 is now explained with reference to FIGS. 3–6 as follows.

Figure 3:
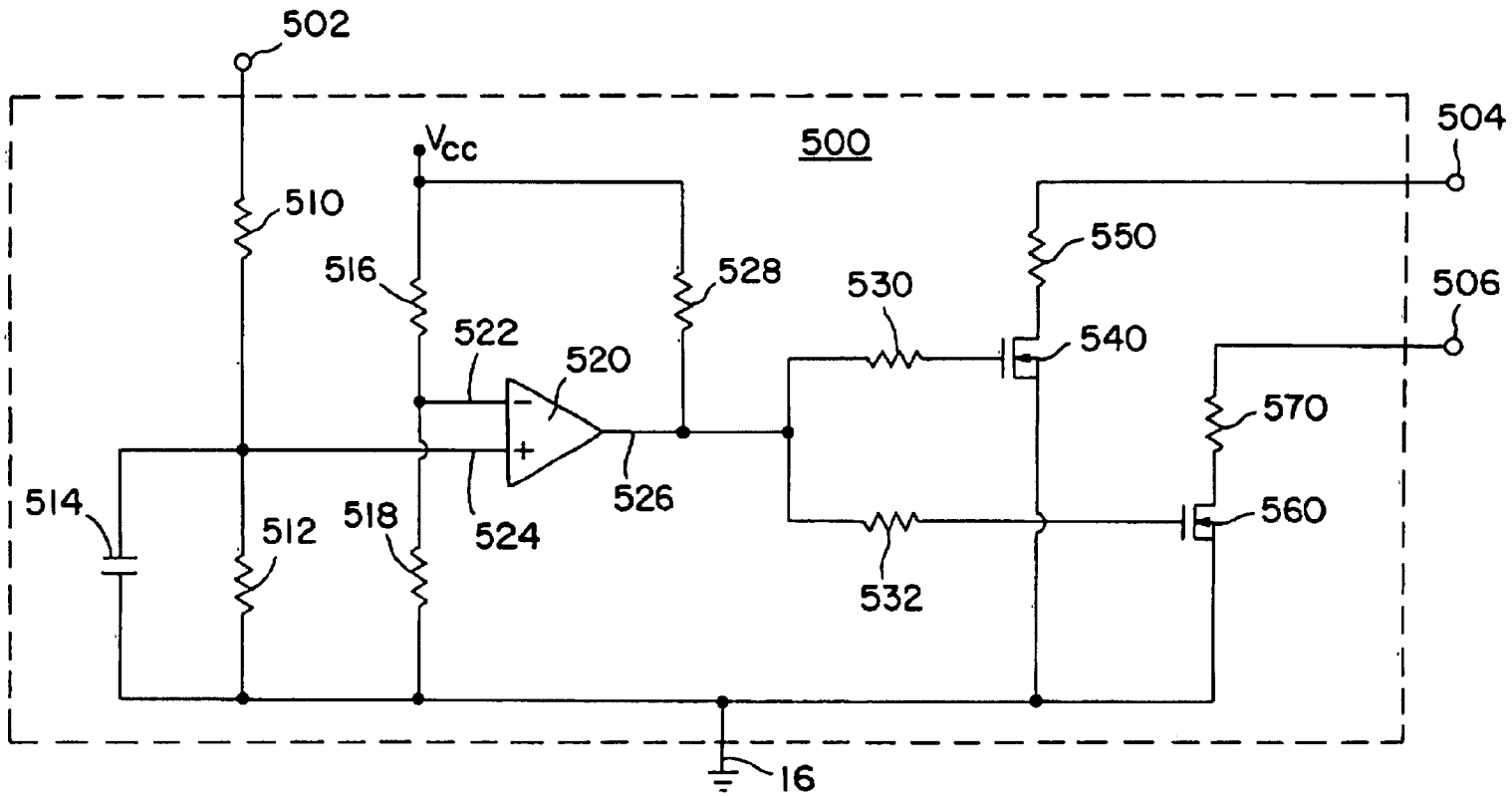
FIG. 3 describes a 120V/277V detector circuit that is part of the dimming signal detector circuit illustrated in FIG. 1, in accordance with a preferred embodiment of the present invention.

Referring to FIG. 3, in a preferred embodiment of the present invention, 120V/277V detector 500 has the following structure and operation. Resistors 510,512 function as a voltage divider for providing a scaled-down version of the AC line voltage to the positive input 524 of comparator 520. Resistors 510,512 are sized such that, for an AC line voltage of 120 volts (rms), the voltage provided to the positive input 524 of comparator 520 will be 4.5 volts. Capacitor 514 serves as a filter capacitor for reducing the low frequency ripple that would otherwise be present in the voltage across resistor 512. Resistors 516,518 are sized so as to bias the inverting input 522 of comparator 520 at 6.0 volts when VCC is set at 14.0 volts. Resistors 530,532 serve as current-limiting resistors for limiting the current that is provided to the gates of transistors 540,560 when the output 526 of comparator 520 goes high.

For an AC line voltage of 120 volts (rms), the voltage at positive input 524 (i.e., 4.5 volts) will be less than the voltage at negative input 522 (i.e., 6.0 volts), so the voltage at comparator output 526 will be zero and, consequently, transistors 540,560 will both be off.

For an AC line voltage of 277 volts (rms), the voltage at positive input 524 will be at about 10.4 volts, which is greater than the voltage at negative input 522 (i.e., 6.0 volts). As a result, the voltage at comparator output 526 will go high and turn on both transistors 540,560. With transistors 540 on, resistor 550 is effectively placed in parallel with resistor 612 (see FIG. 4) in zero crossing detector 600. With transistor 560 on, resistor 570 is effectively placed in parallel (via output 506) with resistor 642 (see FIG. 4) in zero crossing detector 600. Consequently, and referring again to FIG. 4, the voltages that are provided to the positive inputs 624,654 of comparators 620,650 will be proportionately scaled down when the AC line voltage is 277 volts rather than 120 volts. In this way, 120V/277V detector 500 ensures that the signals within zero crossing detector 600 are essentially the same, regardless of whether the AC line voltage is 120 volts or 277 volts.

Figure 4:
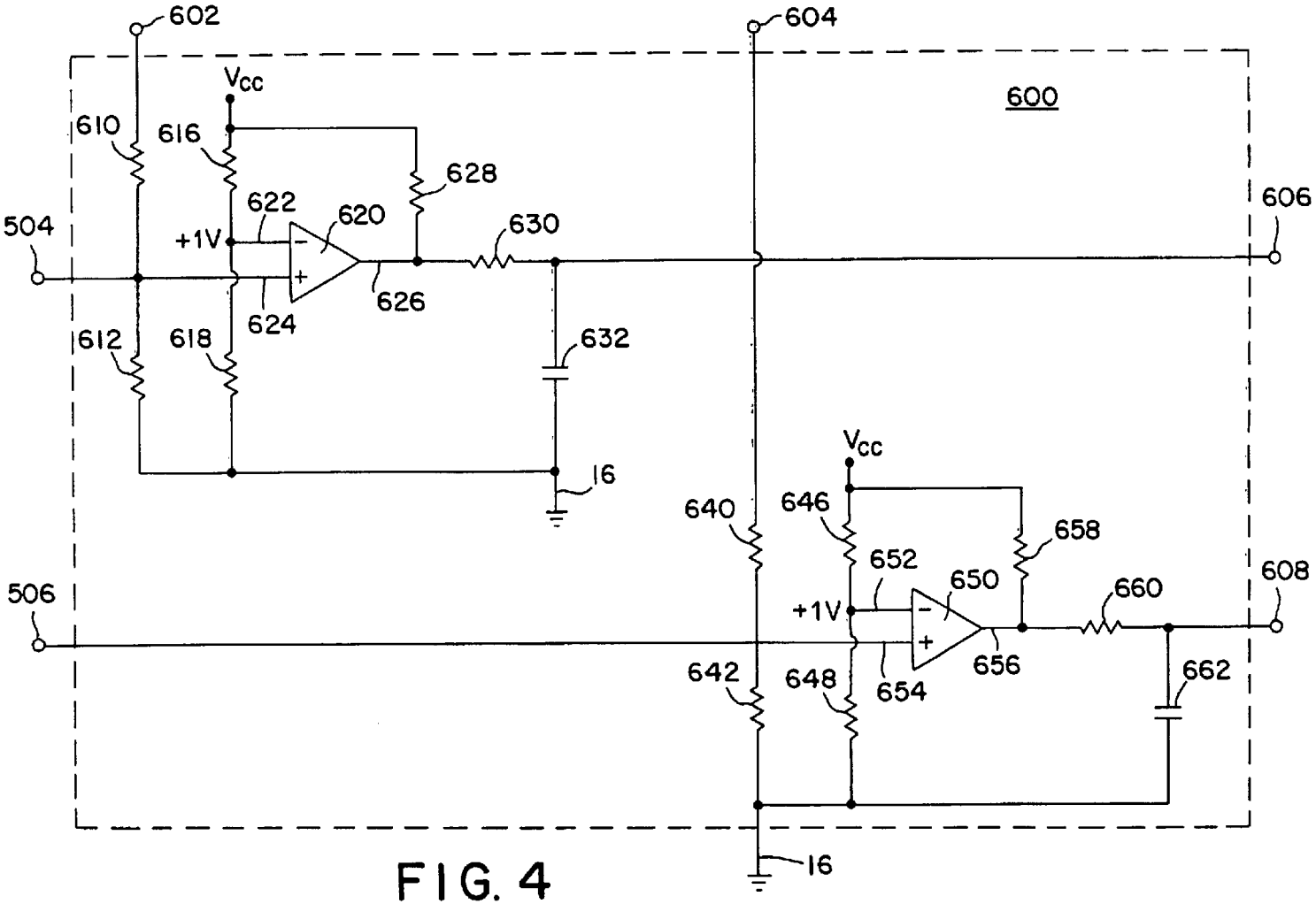
FIG. 4 describes a zero crossing detector circuit that is part of the dimming signal detector circuit illustrated in FIG. 1, in accordance with a preferred embodiment of the present invention.

Referring now to FIG. 4, in a preferred embodiment of the present invention, zero crossing detector 500 has the following structure and operation. Resistors 610,612 function as a voltage divider for providing a scaled-down version of the positive half-cycles (of the AC voltage supplied to the ballast) to the positive input 624 of comparator 620. As previously described with reference to FIG. 3, when the AC line voltage is 277 volts (rms), 120V/277V detector circuit 500 effectively places an additional resistance (i.e., resistor 550 in FIG. 3) in parallel with resistor 612 so as to further scale down the voltage provided to the positive input 624 of comparator 620. Similarly, resistors 640,642 function as a voltage divider for providing a scaled-down version of the negative half-cycles (of the AC voltage supplied to the ballast) to the positive input 654 of comparator 650. As previously described with reference to FIG. 3, when the AC line voltage is 277 volts (rms), 120V/277V detector circuit 500 effectively places an additional resistance (i.e., resistor 570 in FIG. 4) in parallel with resistor 642 so as to further scale down the voltage provided to the positive input 654 of comparator 650.

During operation, the positive and negative half-cycles of the AC voltage supplied to ballast 20 are compared with one volt reference voltages provided at the negative inputs 622,652 of comparators 620,650. The one volt reference voltages are derived from $V_{cc}$ through voltage dividers formed by resistors 616,618 and resistors 646,648. Alternatively, resistors 646,648 may be omitted, and the one volt reference voltage for comparator 650 can be provided simply by connecting the negative input 652 of comparator 650 to the negative input 622 of comparator 620 (in which case resistors 616,618 provide the one volt reference voltage for both comparators 620,650). Resistors 628,658 function as pull-up resistors for biasing the outputs 626,656 of comparators 620,650.

The signals provided at the outputs 626,656 of comparators 620,650 are approximately squarewave voltages with a duration that decreases if a truncated portion is present in the signals provided to positive inputs 624,654. More specifically, if the positive half-cycle is not truncated, the signal at the output 626 of comparator 620 will be a squarewave with the duration of the nonzero portion equal to about 7.7 milliseconds; if, on the other hand, the positive half-cycle is truncated, the signal at the output of comparator 620 will be a squarewave with the duration of the nonzero portion equal to less than 7.7 milliseconds. Along similar lines, if the negative half-cycle is not truncated, the signal at the output 656 of comparator 650 will be a squarewave with the duration of the nonzero portion equal to about 7.7 milliseconds; if, on the other hand, the negative half-cycle is truncated, the signal at the output 656 of comparator 650 will be a squarewave with the duration of the nonzero portion equal to less than 7.7 milliseconds. In this way, zero crossing detector 600 provides outputs that indicate whether or not a "dim" or "brighten" signal has been sent from wall switch assembly 100.

The outputs of comparators 620,650 are filtered through RC filters in order to provide corresponding voltages at outputs 606,608. More specifically, the output of comparator 620 is filtered through an RC filter formed by resistor 630 and capacitor 632, while the output of comparator 650 is filtered through an RC filter formed by resistor 660 and capacitor 662. If a truncated positive half-cycle is detected, the voltage at output 606 will be correspondingly lower than it would be if no truncated positive half-cycle is detected. Similarly, if a truncated negative half-cycle is detected, the voltage at output 608 will be correspondingly lower than it would be if no truncated negative half-cycle is detected.

Figure 5:
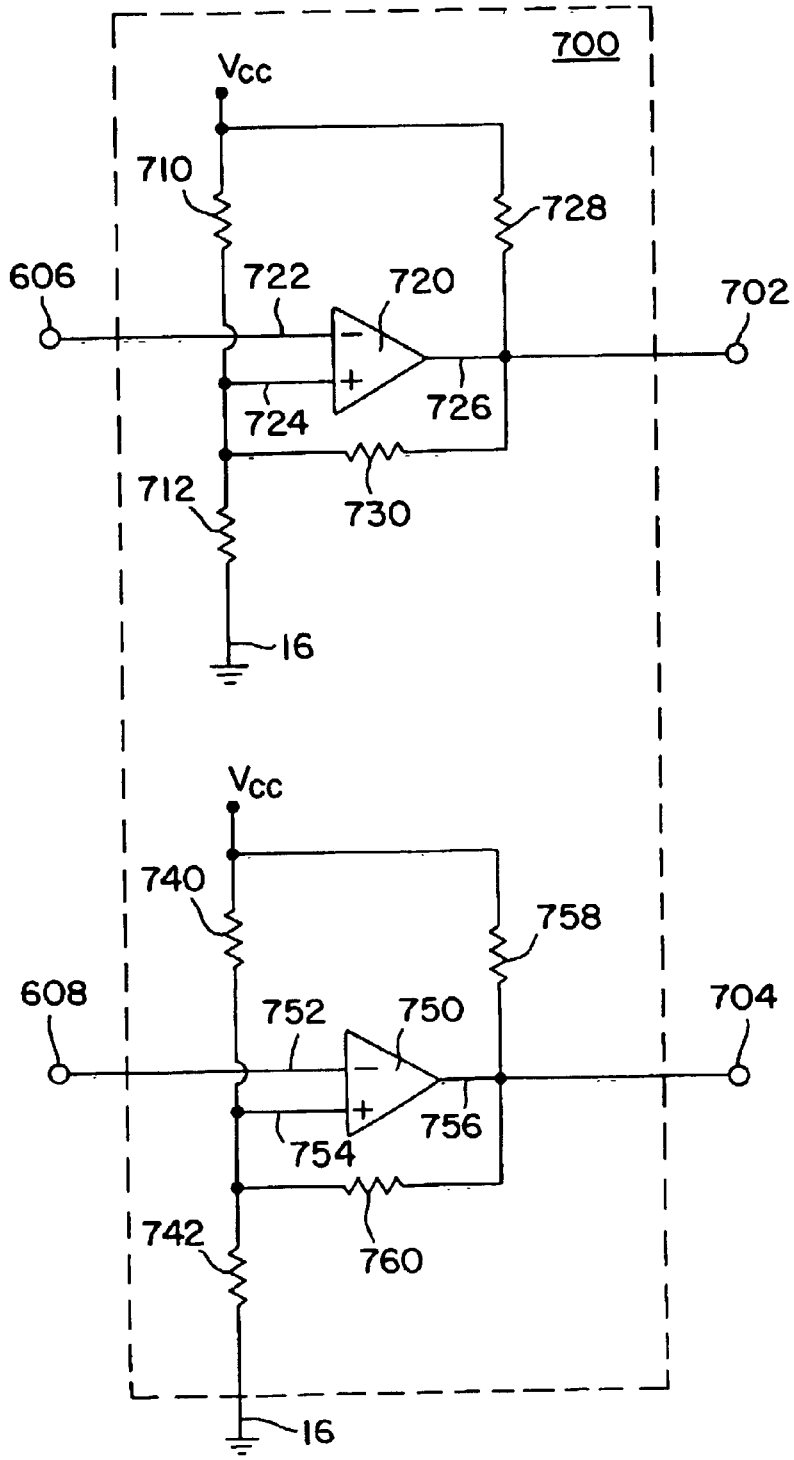
FIG. 5 describes a Schmitt trigger circuit that is part of the dimming signal detector circuit illustrated in FIG. 1, in accordance with a preferred embodiment of the present invention.

Referring now to FIG. 5, in a preferred embodiment of the present invention, Schmitt trigger 700 has the following structure and operation. Resistors 710,712 and resistors 740,742 serve as voltage dividers for providing appropriate reference voltages at the positive inputs 724,754 of comparators 720,750. Resistors 728,758 are pull-up resistors for appropriately biasing outputs 726,756 of comparators 720, 750. Resistors 730,760 provide positive feedback from outputs 726,756 to positive inputs 724,754. Negative inputs 722,752 are coupled to corresponding outputs from zero crossing detector 600, which was previously described with reference to FIG. 4. The outputs 726,756 of comparators 720,750 are coupled to outputs 702,704 of Schmitt trigger 700.

During operation, for both comparators 720,750, as long as the voltage at the negative input (722 or 752) is greater than the reference voltage at the positive input (724 or 754), the output voltage at the comparator output (726 or 756) will be low. Once the voltage at the negative input becomes less than the voltage at the positive input, the voltage at the comparator output will go high. Because positive feedback is provided (via resistors 730,760), when the voltage at the comparator output goes high, that causes the reference voltage at the positive input to increase. Thus, as long as the ripple in the voltage at the negative input is less than the change in the reference voltage, the output voltage will be stable.

Under normal operation, when neither a "dim" nor a "brighten" command has been sent, the voltages at positive inputs 724,754 are less than the reference voltages at negative inputs 722,752. Consequently, the voltages at comparator outputs 726,756 will be low. When a "brighten" command is sent, the DC voltage provided at output 606 of zero crossing detector 600 will decrease. Correspondingly, the voltage at negative input 722 of comparator 720 will decrease to a level that is less than the reference voltage at positive input 724, causing the voltage at output 726 to go high. Once the "brighten" command ceases to be sent, the voltage at output 726 will go back to being low. Along similar lines, when a "dim" command is sent, the DC voltage provided at output 608 of zero crossing detector 600 will decrease. Correspondingly, the voltage at negative input 752 of comparator 750 will decrease to a level that is less than the reference voltage at positive input 754, causing the voltage at output 756 to go high. Once the "dim" command ceases to be sent, the voltage at output 756 will go back to being low.

In this way, Schmitt trigger 700 provides digital output signals at outputs 702,704 that indicate whether or not a "dim" or "brighten" command has been received.

Figure 6:
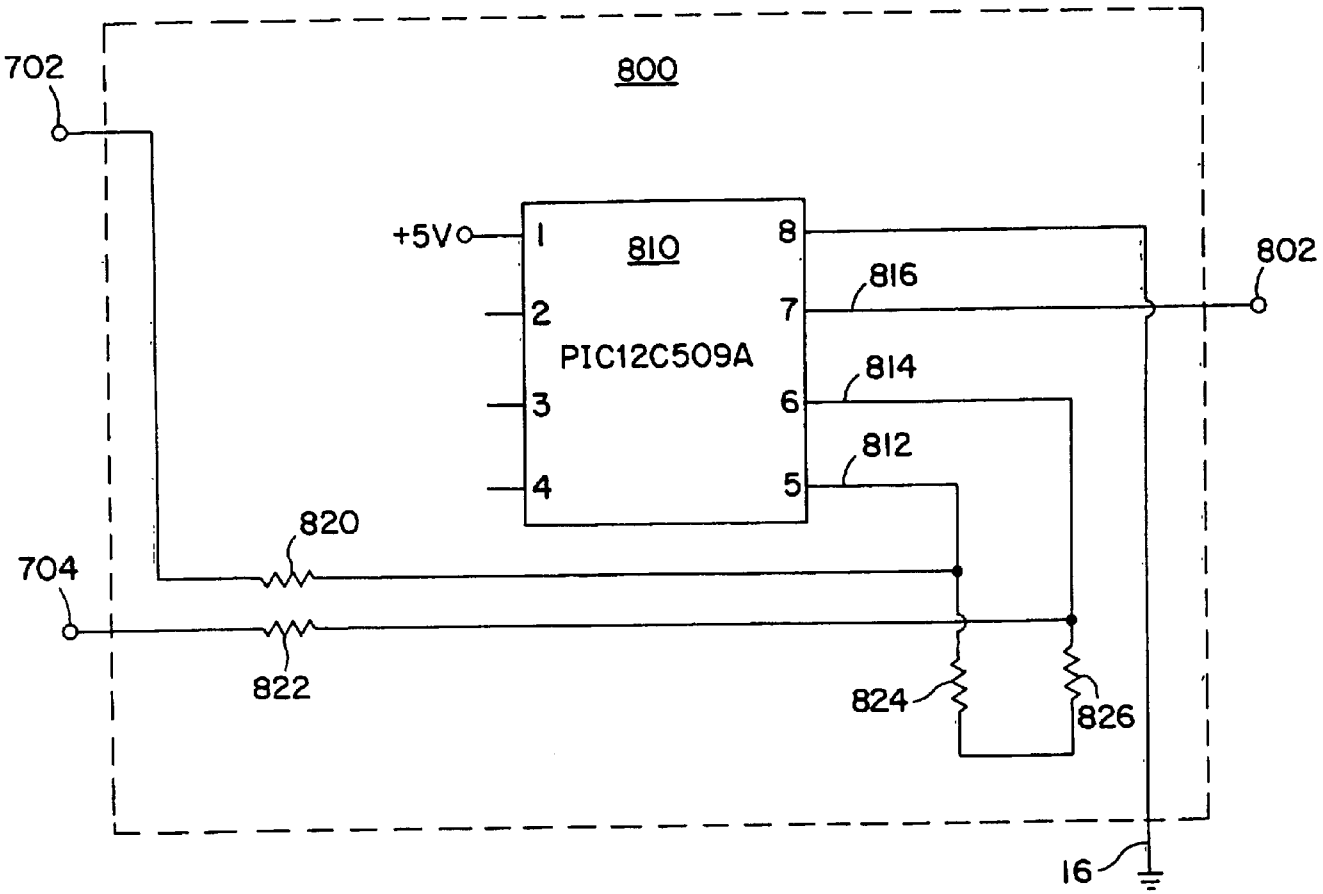
FIG. 6 describes a controller circuit that is part of the dimming signal detector circuit illustrated in FIG. 1, in accordance with a preferred embodiment of the present invention.

Referring now to FIG. 6, in a preferred embodiment of the present invention, controller 800 has the following structure and operation. Resistors 820,822,824,826 form a voltage divider from the outputs 702,704 of Schmitt trigger 700 to the inputs 812,814 of microcontroller 810. Microcontroller 810 may be implemented using any of a number of suitable devices, such as the PIC12C509A 8-bit CMOS microcontroller manufactured by Microchip Technology Inc. Microcontroller 810 is configured to provide at output 816 (and, thus, at output 802) a variable duty cycle squarewave signal, wherein the duty cycle is adjusted in dependence on the signals provided to inputs 812,814. Preferably, the duty cycle is variable between a minimum of about 4.44% and a maximum of about 95.6%. It is further preferred that, upon initial application of power, the duty cycle will be set at its maximum value (which, in a preferred arrangement, correspond to a maximum light output setting).

Input 812 is configured to serve as a "brighten" input, while input 814 serves as a "dim" input. During operation, when no "dim" or "brighten" command has been sent, the signals at inputs 812,814 will both be a logic "0." Under such a condition, the duty cycle of the signal at output 816 will remain unchanged.

When a "dim" command is sent from wall switch assembly 100, the signal at input 812 will be a logic "0" and the signal at input 814 will be a logic "1." Under this condition, microcontroller 810 will decrease the duty cycle of the signal at output 816. If successive "dim" commands are received (e.g., if switch 120 remains open for a sustained period of time, such as one second), microcontroller 810 will continue to incrementally decrease the duty cycle all the way down to the point of reaching the minimum duty cycle (e.g., 4.44%). Once the minimum duty cycle is reached, any further "dim" commands will have no effect on the duty cycle of the signal provided at output 802.

When a "brighten" command is sent from wall switch assembly 100, the signal at input 812 will be a logic "1" and the signal at input 814 will be a logic "0." Correspondingly, microcontroller 810 will increase the duty cycle of the signal at output 816. If successive "brighten" commands are received (e.g., id switch 130 remains open for a sustained period of time, such as one second), microcontroller 810 will continue to incrementally increase the duty cycle all the way up to the point of reaching the maximum duty cycle (e.g., 95.6%). Once the maximum duty cycle is reached, any further "brighten" commands will have no effect on the duty cycle of the signal provided at output 802.

As previously discussed with regard to wall switch assembly 100 (see FIG. 1), it is preferred that switches 120,130 be "ganged" so as to preclude the possibility of both switches being open at the same time. Nevertheless, even if switches 120,130 were to be opened at the same time (i.e., if both a "dim" and "brighten" command were sent at the same time), microcontroller 810 is preferably configured to treat such a condition in the same manner as if neither a "dim" command nor a "brighten" command were sent. More specifically, microcontroller 810 is preferably configured so as to treat the simultaneous occurrence of a logic "1" at both inputs 812,814 in the same manner as the simultaneous occurrence of a logic "0" at both inputs 812,814.

In this way, wall switch assembly 100 and dimming signal detector 400 provide a variable duty cycle control voltage that can be provided to the ballast inverter in order to effect dimming of the lamp(s) connected to the ballast output.

While the preceding description has discussed "dim" and "brighten" commands that originate via user manipulation of switches 120,130 of wall switch assembly 100 (see FIG. 1), it should be appreciated that dimming signal detector 400 is likewise capable of receiving those commands directly from the electric utility company. For instance, the utility company may itself implement a "load shedding" protocol wherein the utility company provides a "dim" command simply by truncating a predetermined number of negative half-cycles of the AC line voltage. Dimming signal detector 400 will detect the truncated negative half-cycles and adjust its output in the same manner as it does in response to a series of "dim" commands sent via the momentary opening of switch 120. At the end of the "load shedding" period (e.g., once the power demand experienced by the electrical utility has decreased sufficiently to obviate the need for load shedding), the utility company may provide a "brighten" command simply by truncating a series of positive half-cycles of the AC line voltage. Dimming signal detector 400 will detect the truncated positive half-cycles and adjust its output in the same manner as it does in response to a series of "brighten" commands sent via the momentary opening of switch 120. Thus, in addition to the other benefits previously discussed herein, the present invention easily accommodates load shedding strategies.

Although the present invention has been described with reference to certain preferred embodiments, numerous modifications and variations can be made by those skilled in the art without departing from the novel spirit and scope of this invention.

What is claimed is:

1. An arrangement, comprising:

a first circuit having a first end and a second end, wherein the first end is coupled to a hot lead of a source of alternating current (AC) voltage, the first circuit being operable to receive a first user command and a second user command, and to provide:

(i) in the absence of a user command, a normal operating mode wherein the first end is electrically shorted to the second end;

(ii) in response to the first user command, a brighten mode wherein a portion of positive-going current is prevented from flowing from the first end to the second end; and (iii) in response to the second user command, a dim mode wherein a portion of negative-going current is prevented from flowing from the first end to the second end; and a second circuit coupled to the second end of the first circuit and a neutral lead of the source of AC voltage, the second circuit having an output adapted for connection to inverter circuitry within an electronic dimming ballast operable to set an illumination level of a lamp in dependence on a dimming control signal, the second circuit being operable to provide the dimming control signal at its output in dependence on the user commands received by the first circuit.

2. The arrangement of claim 1, wherein the first circuit is further operable to provide an output voltage between the second end and the neutral lead of the AC voltage source, the output voltage being a substantially sinusoidal signal having a positive half-cycle and a negative half-cycle, wherein:

(i) in response to the first user command, an initial portion of the positive half-cycle is truncated; and (ii) in response to the second user command, an initial portion of the negative half-cycle is truncated.

3. The arrangement of claim 1, wherein the first circuit is situated within an electrical switchbox in a building.

4. The arrangement of claim 1, wherein the second circuit is situated within the electronic dimming ballast.

5. The arrangement of claim 1, wherein the dimming control signal has a duty cycle that is:

(i) increased in response to the first user command; and (ii) decreased in response to the second user command.

6. The arrangement of claim 5, wherein:

the increase in the duty cycle of the dimming control signal is dependent on the duration of the first user command; and the decrease in the duty cycle of the dimming control voltage is dependent on the duration of the second user command.

7. The arrangement of claim 1, wherein the first circuit further comprises:

a first rectifier having an anode and a cathode, wherein the anode is coupled to the first end;

a second rectifier having an anode coupled to the second end and a cathode coupled to the cathode of the first rectifier;

a first normally-closed switch coupled in parallel with the first rectifier;

a second normally-closed switch coupled in parallel with the second rectifier;

a controllable bi-directional conduction device having a first conduction terminal, a second conduction terminal, and a gate, wherein the first conduction terminal is coupled to the anode of the first rectifier, and the second conduction terminal is coupled to the anode of the second rectifier;

a voltage triggered device coupled between a node and the gate terminal of the controllable bi-directional conduction device;

a triggering resistor coupled between the node and the anode of the fast rectifier; and a triggering capacitor coupled between the node and the anode of the second rectifier.

8. The arrangement of claim 7, wherein:

the controllable bi-directional conduction device is a triac; and the voltage triggered device is a diac.

9. The arrangement of claim 7, wherein:

the first user command is generated by opening the second normally-closed switch for a limited period of time; and the second user command is generated by opening the first normally-closed switch for a limited period of time.

10. An arrangement, comprising:

a wall-switch assembly, comprising:

a first rectifier having an anode and a cathode, wherein the anode is coupled to the first end;

a second rectifier having an anode coupled to the second end and a cathode coupled to the cathode of the first rectifier;

a first normally-closed switch coupled in parallel with the first rectifier;

a second normally-closed switch coupled in parallel with the second rectifier;

a controllable bi-directional conduction device having a first conduction terminal, a second conduction terminal, and a gate, wherein the first conduction terminal is coupled to the anode of the first rectifier, and the second conduction terminal is coupled to the anode of the second rectifier;

a voltage triggered device coupled between a node and the gate terminal of the controllable bi-directional conduction device;

a triggering resistor coupled between the node and the anode of the first rectifier; and a triggering capacitor coupled between the node and the anode of the second rectifier; and a ballast for powering at least one gas discharge lamp at an adjustable illumination level, wherein the ballast is operable to adjust the illumination level in response to a momentary opening of at least one of: (i) the first normally-closed switch; and (ii) the second normally-closed switch.

11. The arrangement of claim 10, wherein the illumination level is:

(i) increased in response to a momentary opening of the second normally-closed switch; and (ii) decreased in response to a momentary opening of the first normally-closed switch.

12. The arrangement of claim 10, wherein:

the controllable bi-directional conduction device is a triac; and the voltage triggered device is a diac.

* * * * *